United States Patent [19]

Isozumi

[11] Patent Number: 4,924,108

[45] Date of Patent: May 8, 1990

[54] COAXIAL TYPE STARTER DEVICE

[75] Inventor: Shuzoo Isozumi, Himeji, Japan

[73] Assignee: Mitsubishi Denki Kabushiki Kaisha, Tokyo, Japan

[21] Appl. No.: 298,437

[22] Filed: Jan. 18, 1989

[30] Foreign Application Priority Data

Feb. 2, 1988 [JP] Japan ..... 63-23266

[51] Int. Cl.[5] ..... F02N 15/06

[52] U.S. Cl. ..... 290/48; 74/7 E

[58] Field of Search ..... 290/38 R, 48; 74/7 R, 74/7 A, 7 C, 7 E

[56] References Cited

U.S. PATENT DOCUMENTS

| | | | |
|---|---|---|---|
| 4,525,632 | 10/1985 | Tanaka | 290/38 R |
| 4,760,274 | 7/1988 | Isozumi | 290/48 |
| 4,800,766 | 1/1989 | Isozumi et al. | 74/7 E |
| 4,825,095 | 4/1989 | Morishita | 290/48 |

FOREIGN PATENT DOCUMENTS 1311876 7/1962 France .

*Primary Examiner*—A. D. Pellinen
*Assistant Examiner*—W. E. Duncanson, Jr.
*Attorney, Agent, or Firm*—Sughrue, Mion, Zinn, Macpeak and Seas

[57] ABSTRACT

A coaxial type starter device comprises a d.c. motor, a pinion provided at the front end of an armature rotary shaft of the d.c. motor and an output rotary shaft arranged in alignment with the armature rotary shaft so as to be movable in its axial direction so that a rotating force of the armature rotary shaft is transmitted to the output rotary shaft through a planet gear speed-reducing device and an overrunning clutch device, wherein a carrier for supporting each planet gear wheel has a cylindrical portion at its front end and the cylindrical portion is fitted to the outer circumference of an clutch outer member of the overrunning clutch device so as to cause a relative sliding movement in their circumferential directions when a predetermined torque is produced.

4 Claims, 3 Drawing Sheets

COAXIAL TYPE STARTER DEVICE

The present invention relates to a coaxial type starter device. More particularly, it relates to a coaxial type starter device used for starting the engine of an automobile.

DISCUSSION OF BACKGROUND

Heretofore, a conventional starter device used for starting the engine of an automobile is of a so-called biaxial structure wherein an electromagnetic switch device for feeding power to a d.c. motor is disposed at the side of the d.c. motor.

However, such biaxial type starter device gave a great restriction when an engine for an automobile is to be designed.

There has been a proposal to make the shape of a starter device simple. According to the proposal, the starter device is so constructed that it has a generally elongated cylindrical form by arranging an electromagnetic switch device at an end in the axial direction of a d.c. motor.

The proposed starter device is illustrated in FIG. 3. In FIG. 3, a coaxial type starter device 1 is such that an armature rotary shaft 3 of a d.c. motor 2 is hollow; a plunger rod 4*a* of an electromagnetic switch device 4 disposed at the rear end of the d.c. motor 2 is extended in the inner passage 3*a* of the hollow armature rotary shaft 3; and an output rotary shaft 5 is inserted in the armature rotary shaft 3 in a coaxial manner so that the rear end of the output rotary shaft 5 is in contact with the free end of the plunger rod 4*a*, whereby when the electromagnetic switch device is actuated, the output rotary shaft 5 is pushed forwardly by means of the plunger rod 4*a* .

A sun gear wheel 6*a* is formed in the outer circumferential portion of the front end of the armature rotary shaft 3, and a plurality of planet gear wheels 6*b* are interlocked with the sun gear wheel 6*a*. The planet gear wheels 6*b* are also interlocked with an internal gear wheel 6*c* formed in the inner circumferential surface of a machine frame 7, and each of the planet gear wheels 6*b* is supported by a carrier 6*e* by means of each shaft 6*d*. The sun gear wheel 6*a*, the planet gear wheels 6*b*, the internal gear wheel 6*c*, the shafts 6*d* and the carrier 6*e* constitute a planet gear speed-reducing device 6 which reduces a rotating speed of the armature rotary shaft 3.

An overrunning clutch device 8 is fitted to the output rotary shaft 5. A clutch inner member 8*a* of the overrunning clutch device 8 is interlocked with a helical spline 5*b* formed in a spline forming section 5*a* of the output rotary shaft 5, the spline forming section 5*a* having an outer diameter greater than the inner diameter of the inner passage 3*a* of the hollow armature rotary shaft 3, whereby the output rotary shaft 5 can receive a rotating force from the clutch inner member 8*a* and is slidable in its axial direction. A pinion 9 is attached to the front end of the output rotary shaft 5 so as to be engaged with and disengaged from a ring gear of an engine (not shown). When the output rotary shaft 5 is caused to slide forwardly, the pinion 9 is engaged with the ring gear to rotate it.

However, the conventional coaxial starter device as described above had a disadvantage as follows. When the engine or the starter device is in an idling operation and if the key switch of the automobile is turned on, the pinion of the starter device comes to engagement with the ring gear of the engine to cause a shock to the structural elements of the starter device. In this case, the shock can hardly be absorbed by an absorbing energy by the torsional regidity of the overrunning clutch, and the shock sometimes breaks the structural elements.

SUMMARY OF THE INVENTION

It is an object of the present invention to provide a coaxial type starter device capable of rapidly absorbing a shock without any influence on the structural elements even when there is a large shock by an abnormal engagement between the pinion of the starter device and the ring gear of an automobile engine.

The foregoing and other objects of the present invention have been attained by providing a coaxial type starter device comprising a d.c. motor, a pinion provided at the front end of an armature rotary shaft of the d.c. motor and an output rotary shaft arranged in alignment with the armature rotary shaft so as to be movable in its axial direction so that a rotating force of the armature rotary shaft is transmitted to the output rotary shaft through a planet gear speed-reducing device and an overrunning clutch device, the coaxial type starter device being characterized in that a carrier for supporting each planet gear wheel has a cylindrical portion at its front end and the cylindrical portion is fitted to the outer circumference of an clutch outer member of the overrunning clutch device so as to cause a relative sliding movement in their circumferential directions when a predetermined torque is produced.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
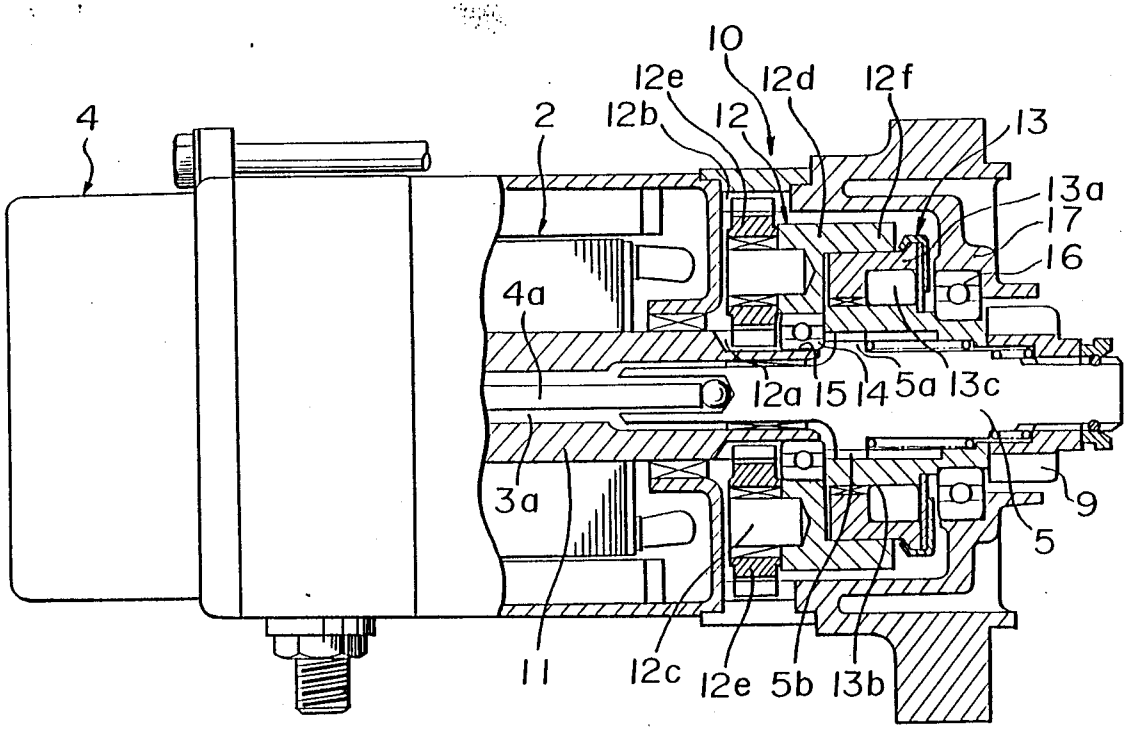
FIG. 1 is a front view partly broken of an embodiment of the coaxial type starter device according to the present invention.
Figure 2:
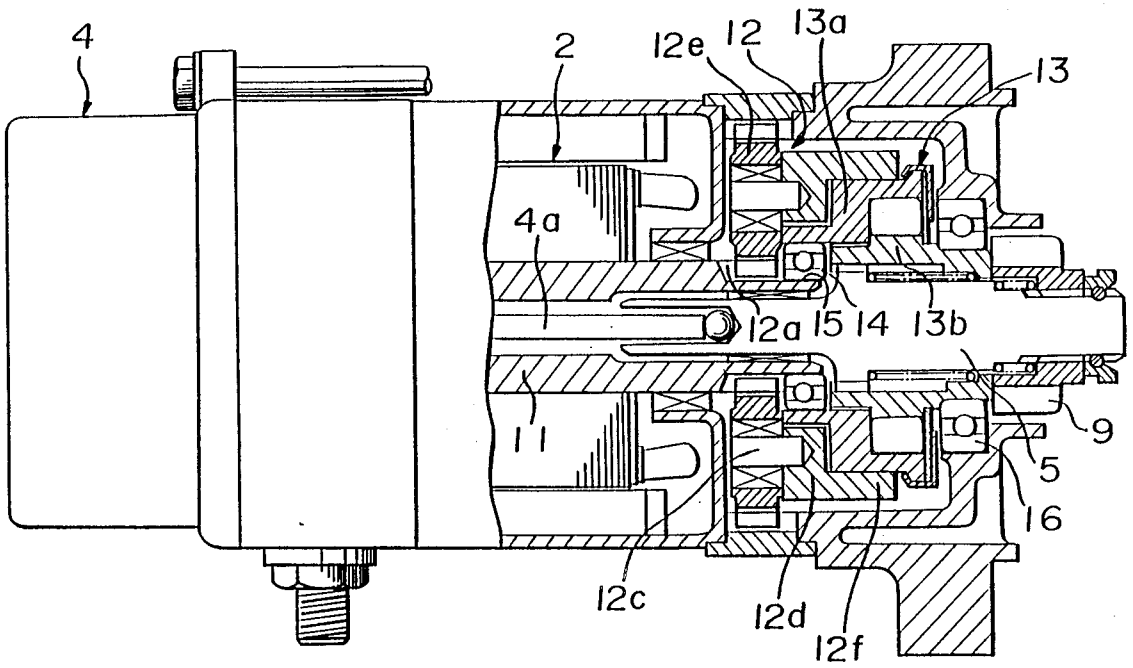
FIG. 2 is a front view partly broken of another embodiment of the coaxial type starter device according to the present invention.

Referring to the drawings, wherein the same reference numerals designate the same or corresponding parts throughout the several views, and more particularly to FIG. 1 thereof, there is shown a front view of a typical example of the coaxial type starter device of the present invention.

In FIG. 1, a reference numeral 10 designates a coaxial type starter device. A rotating force produced by an armature rotary shaft 11 is transmitted to an output rotary shaft 5 by means of a planet gear wheel speed-reducing device 12 and an overrunning clutch device 13 in the same manner as described with respect to the conventional starter device. In the present invention, the planet gear wheel speed reducing device 12 is constituted by a sun gear wheel 12*a* formed in the outer circumferential portion at the front end of the armature rotary shaft 11, an internal gear wheel 12*b* formed in the inner surface of the machine frame of the starter device 20 and a plurality of planet gear wheels 12*e* which are interlocked with both the sun gear wheel 12*a* and the internal gear wheel 12*b* and are supported by a carrier 12*d* by means of each pin 12*c*.

Figure 3:
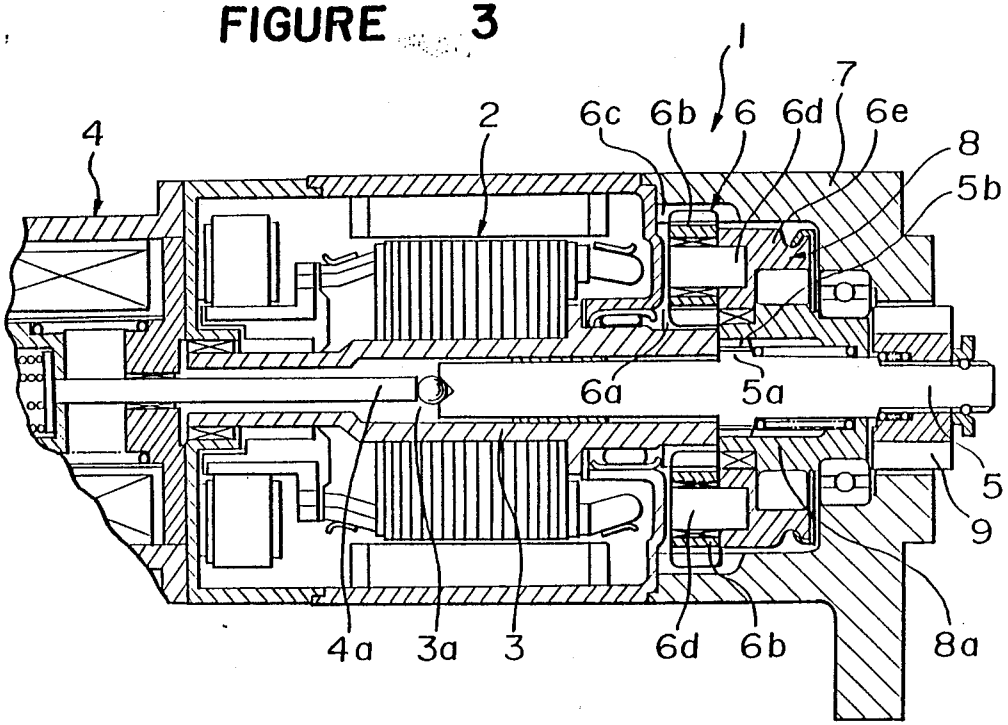
FIG. 3 is a cross-sectional view showing a conventional coaxial type starter device.

A reduced diameter portion or a step portion 15 is formed in the outer circumference of the front end portion adjacent to the sun gear wheel 12*a* of the armature rotary shaft 11, and the carrier 12*d* of the planet gear wheel speed-reducing device 12 is fitted to the reduced diameter portion 15 by means of a ball bearing 14 attached to the inner circumferential portion of the carrier 12*d*. A construction that the carrier 12*d* is directly supported by the armature rotary shaft 11 by means of the ball bearing 14 provides an advantage as follows. Namely, in considering the relation between the sun gear wheel and the planet gear wheels, it is desirable that each of the planet gear wheels revolve in such a manner that the axial center lines of revolution are always in coincidence with the axial center line of the armature rotary shaft. However, as shown in FIG. 3 illustrating the conventional coaxial type starter device 1, when the carrier 6*e* is supported by a bearing at the rear end of the clutch inner member 8*e* of the overrunning clutch device 8, it is difficult to maintain the axial center of revolution of the carrier, i.e. the axial center of revolution of the planet gear wheels to a predetermined position when we consider a state of engagement of the overrunning clutch device 8 with the output rotary shaft 5 by means of a helical spline. As a result, when there causes a deflection in the overrunning clutch device, abnormal noises are produced from the interlocking portion in the planet gear wheel speed-reducing device. Or, end surfaces of the gear wheels are worn. Further, when an abnormal load is applied to the speed-reducing device 12 in addition to a shock caused by the re-engagement of the pinion 9 with the ring gear, there may invite destruction of the device. However, with the construction as shown in FIG. 1, i.e. the carrier 12*d* directly supported by the armature rotary shaft 11 by means of the ball bearing 14, the axial center line of revolution of the planet gear wheels is entirely in agreement with the axial center line of the armature rotary shaft 11 in view of the structure as in FIG. 1 if machining is accurately carried out. Thus, the above-mentioned disadvantage can be eliminated.

The carrier 12*d* of the planet gear wheel speed-reducing device 12 has a cylindrical portion 12*f* whose front end is open. The cylindrical portion 12*f* is forcibly fitted to the outer circumference of an clutch outer member 13*a* of the overrunning clutch device 13 so that there causes a relative sliding movement in their circumferential directions when a predetermined torque is produced in the planet gear wheel speed-reducing device 12. Accordingly, when the starter device is normally operated, the carrier 12*d* is rotated together with the clutch outer member 13*a* of the overrunning clutch device 13.

The clutch inner member 13*b* of the overrunning clutch device 13 is held by a front bracket 17 at its front end part by means of a bearing 16. The front end of the clutch inner member 13*b* is extended from the position at which the bearing 16 is located toward a pinion 9 so that it comes to contact with the side surface of the pinion 9 when it is retracted backwardly. On the other hand, the rear end surface of the clutch inner member 13*b* is substantially in contact with the carrier 12*d* or a side surface of the outer race of the ball bearing 14. In the conventional coaxial type starter device as shown in FIG. 3, which has such construction that the rear end surface of the spline forming portion of the output rotary shaft is brought into contact with the front end of the armature rotary shaft to stop the pinion at a predetermined position when the pinion is retracted, it is difficult to assure stopping of the output rotary shaft at an accurate stopping position because of the wearing of them at the contact portion since there is a great difference of revolution speed between the armature rotary shaft and the output rotary shaft. In accordance with the construction as shown in FIG. 1, such problem can be eliminated. Namely, there is no great difference of rotation between the clutch inner member 13*b* and the carrier 12*d* or the outer race of the ball bearing 14 because a rotating speed of the armature rotary shaft is reduced by the planet gear wheel speed-reducing device 12, whereby there is less wearing at the contacting portion, and an accurate position of the pinion can be maintained when it is retracted.

The operation of the coaxial type starter device of the above-mentioned embodiment will be described.

When the starter switch of an automobile is turned on, an electric current is fed to an excitation coil of the electromagnetic switch device 4, whereby the rod 4*a* is moved on the right in the axial direction in FIG. 1 due to an electromagnetic force produced in the excitation coil. As a result, the output rotary shaft 5 is pushed and the pinion 9 provided at its front end is interlocked with the ring gear of the engine. At the same time, the movement of the plunger causes a mutual contact of the movable and fixed contacts (not shown) so that a power source is connected to the d.c. motor 2 to thereby actuate the same. As a result, a rotating force caused by the armature rotary shaft 11 is transmitted to the clutch outer member 13*a* of the overrunning clutch device 13 while a rotating speed is reduced by the planet gear wheel speed-reducing device 12. A torque of the clutch outer member 13*a* is transmitted to the clutch inner member 13*b* by means of cylindrical rollers 13*c*. The rotating force of the clutch inner member 13*b* is transmitted to the output rotary shaft 5 by means of the helical spline, whereby the engine is started by means of the pinion 9 attached to the output rotary shaft 5.

After the engine has been started, the transmission of the rotating force to the d.c. motor is prohibited by a reverse-driving by means of the overrunning clutch device 13, and at the same time, the output rotary shaft 5 and the plunger rod 4*a* of the electromagnetic switch device 4 are returned to the original position by a return spring which is arranged at an appropriate position.

When the pinion 9 is brought into engagement with the ring gear which is in an idling operation and if an abnormal shock is applied to the pinion 9, there causes a mutual sliding movement at the fitting portion between the cylindrical portion 12*f* at the front end of the carrier of the planet gear wheel speed-reducing device 12 and the clutch outer member 13*b*. As a result, the shock can be absorbed at the fitting portion to thereby prevent the breakage of the structural elements of the speed-reducing device.

In the above-mentioned embodiment, the ball bearing 14 fitted to the inner circumferential portion of the carrier 12*d* is fitted to the reduced diameter portion or the shoulder portion 15 at the front end of the armature rotary shaft 11 to thereby hold the carrier 12*d*. However, a construction as shown in FIG. 3 may be used. Namely, the rear end portion of the clutch outer member 13*a* is extended to the inner circumferential portion of the carrier 12*d*, and the ball bearing 14 is fitted between the inner circumferential surface of the rear end extension of the clutch outer member 13*a* and the reduced diameter portion 15 of the armature rotary shaft 11. By using this construction, the axial center line of rotation of the carrier 12*d* can be made in coincidence with that of the armature rotary shaft 11 since the cylindrical portion at the front end of the carrier 12*d* is fitted to the clutch outer member 13*a*. Accordingly, there is obtainable the construction of the planet gear wheel speed-reducing device free from a deflection of the center.

In the present invention, the fitting of the cylindrical portion 12*f* at the front end of the carrier 12*d* to the clutch outer member 13*a* can be carried out not only by forcibly fitting but also by shrinkage fitting or another fitting means as far as a mutually sliding operation in their circumferential directions can be produced when a predetermined torque is given.

As described above, in accordance with the coaxial type starter device of the present invention, when a large shock is applied to the starter device due to an abnormal load by the cause of an abnormal engagement of the pinion with the ring gear of the engine, the shock can rapidly be absorbed by the mutual sliding movement between the cylindrical portion at the front end of the carrier and the clutch outer member, whereby possible damage of structural elements in the starter device can be eliminated.

Obviously, numerous modifications and variations of the present invention are possible in light of the above teachings. It is therefore to be understood that within the scope of the appended claims, the invention may be practiced otherwise than as specifically described herein.

What is claimed is:

1. A coaxial type starter device comprising a d.c. motor, a pinion provided at the front end of an armature rotary shaft of said d.c. motor and an output rotary shaft arranged in alignment with said armature rotary shaft so as to be movable in its axial direction so that a rotating force of said armature rotary shaft is transmitted to said output rotary shaft through a planet gear speed-reducing device and an overrunning clutch device, said coaxial type starter device being characterized in that a carrier for supporting each planet gear wheel has a cylindrical portion at its front end and said cylindrical portion is fitted to the outer circumference of a clutch outer member of said overrunning clutch device so as to cause a relative sliding movement in their circumferential directions when a predetermined torque is produced.

2. The coaxial type starter device according to claim 1, wherein said carrier is supported by said armature rotary shaft by means of a ball bearing at the front end of said armature rotary shaft.

3. The coaxial type starter device according to claim 2, wherein said armature rotary shaft has a reduced diameter portion at its front end and in vicinity of a sun gear wheel formed in said armature rotary shaft and said carrier is disposed on said reduced diameter portion by means of said ball bearing.

4. The coaxial type starter device according to claim 1, wherein said clutch outer member is disposed on an inner clutch member by means of cylindrical rollers.

* * * * *